US006619437B2

(12) United States Patent
Hikita

(10) Patent No.: US 6,619,437 B2
(45) Date of Patent: Sep. 16, 2003

(54) ELEVATOR GROUP CONTROL APPARATUS

(75) Inventor: Shiro Hikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/132,308

(22) Filed: Apr. 26, 2002

(65) Prior Publication Data

US 2003/0098208 A1 May 29, 2003

(30) Foreign Application Priority Data

Nov. 26, 2001 (JP) ..... 2001-359941

(51) Int. Cl.[7] ..... B66B 1/20
(52) U.S. Cl. ..... 187/383; 187/902
(58) Field of Search ..... 187/247, 380, 187/382, 383, 385, 387, 388, 902

(56) References Cited

U.S. PATENT DOCUMENTS

| | | | | |
|---|---|---|---|---|
| 4,632,224 A | * | 12/1986 | Nowak et al. | 187/387 |
| 4,838,385 A | * | 6/1989 | Ekholm | 187/247 |
| 5,300,739 A | * | 4/1994 | Bittar | 187/385 |
| 5,317,114 A | * | 5/1994 | Pullela et al. | 187/383 |
| 5,663,539 A | * | 9/1997 | Powell et al. | 187/385 |
| 5,823,299 A | * | 10/1998 | Wierschke et al. | 187/277 |
| 6,161,652 A | * | 12/2000 | Kostka et al. | 187/291 |
| 6,176,351 B1 | * | 1/2001 | Ikeda et al. | 187/387 |
| 6,273,217 B1 | | 8/2001 | Hikita | |
| 6,364,065 B1 | | 4/2002 | Hikita | |

FOREIGN PATENT DOCUMENTS

| | | |
|---|---|---|
| JP | 6-305684 | 11/1994 |
| JP | 2000-226164 | 8/2000 |
| JP | 2001-130843 | 5/2001 |

* cited by examiner

*Primary Examiner*—Jonathan Salata
(74) *Attorney, Agent, or Firm*—Leydig, Voit & Mayer, Ltd.

(57) ABSTRACT

In an elevator system in which two cars operate in each shaft, there is provided an elevator group control apparatus providing efficient services while preventing collisions of cars in each shaft. The elevator group control apparatus includes a traffic detection part which detects data of car traffic generated in a building; a zone setting part which sets a dedicated zone and a common zone for each of upper and lower cars in accordance with detection by the traffic detection part; an assignment decision part which decides a car to be assigned to a call generated at a hall in accordance with the call generation floor, direction of response to the call, and a zone set by the zone setting part; an entry determination part which, when a first of two cars in each shaft is coming into the common zone from its dedicated zone, determines, based on position, direction of movement, and state of the other car in the same shaft, whether the first car in each shaft is permitted to enter the common zone; a passing-by instruction part which gives a passing-by instruction to a prescribed floor in the dedicated zone to make each car exit from the common zone to its dedicated zone after each car has entered the common zone; and an operation control part which controls operation of each car based on a decision by the assignment decision part, a determination by the entry determination part, and an instruction by the passing-by instruction part.

3 Claims, 7 Drawing Sheets

ELEVATOR GROUP CONTROL APPARATUS

This application is based on Application No. 2001-359941, filed in Japan on Nov. 26, 2001, the contents of which are hereby incorporated by reference.

BACKGROUND OF THE INVENTION

1. Field of the Invention

The present invention relates to an elevator group control apparatus for efficiently controlling a plurality of elevators of the same bank in an elevator system with two cars operating in one shaft.

2. Description of the Related Art

In cases where a plurality of elevators are provided, group control is usually performed on these elevators. When group control is applied to an elevator system with a plurality of cars operating in one shaft, it is necessary to carry out such group control so as to improve the transportation efficiency of the elevator system as a whole while avoiding collisions of the cars operating in the same shaft, which is the most different from an ordinary elevator system with one car operating in one shaft.

Such an elevator group control apparatus as taking this difference into consideration is disclosed in Japanese Patent No. 3,029,168, corresponding to Unexamined Japanese Patent Publication Hei. 6-305648, for instance. In this prior art reference, there is proposed a control technique in which a car entry preventive range is set for an elevator system performing a circulation type (horizontally movable) operation, so that cars are controlled to be prevented from entering this range.

However, such a prior art technique is based on the circulation-type elevator system as a precondition, and hence it is difficult to apply this technique to an elevator system incapable of horizontal movement for the following reasons. That is, in the circulation-type elevator system, it is presumed that respective elevators in the same shaft run in the same direction, so passing-by of the elevators depends on the horizontal movement thereof, and thus no consideration is given to how to achieve collision prevention and passing-by of cars in elevator systems in which cars can not move in the horizontal direction.

SUMMARY OF THE INVENTION

The present invention is intended to obviate the problem as referred to above, and has for its object to provide an elevator group control apparatus which is capable of performing group control on an elevator system having two cars operating in each shaft with improved efficiency while preventing the possibility of collisions of the cars as much as possible. Bearing the above object in mind, the present invention resides in an elevator group control apparatus in an elevator system with two vertically movable elevators operating in each shaft. The elevator group control apparatus includes; a traffic detection part which detects data of car traffic generated in a building; a zone setting part which sets a dedicated zone and a common zone for each of upper and lower cars in accordance with the results of detection of the traffic detection part; an assignment decision part which decides a car to be assigned to a call generated at a hall in accordance with a call generation floor, a direction of the call, and a zone set by the zone setting part; an entry determination part which, when one of two cars in each shaft is coming into the common zone from its dedicated zone, determines, based on the position, the direction of movement, and the state of the other car in the same shaft, whether the one car in each shaft is permitted to enter the common zone; a passing-by instruction part which gives a passing-by instruction to a prescribed floor in the dedicated zone so as to make each car exit from the common zone to its dedicated zone after each car has entered the common zone; and an operation control part which controls operation of each car based on the results from the assignment decision part, the entry determination part and the passing-by instruction part. With this arrangement, it is possible to achieve excellent operation efficiency while preventing collisions of the cars in each shaft as much as possible.

In a preferred form of the present invention, the passing-by instruction part prepares a virtual call at the lowermost floor of the upper car dedicated zone when the upper car has entered the common zone, and a virtual call at the uppermost floor of the lower car dedicated zone when the lower car has entered the common zone.

In another preferred form of the present invention, the passing-by instruction part cancels a passing-by virtual call when a car, which exists in the common zone and already has a passing-by virtual call, is assigned to a hall call generated in the dedicated zone, or when a car call for making a car come to its dedicated zone is given to a car existing in the common zone and already having a passing-by virtual call.

The above and other objects, features and advantages of the present invention will become more readily apparent to those skilled in the art from the following detailed description of a preferred embodiment of the present invention taken in conjunction with the accompanying drawings.

DESCRIPTION OF THE PREFERRED EMBODIMENT

Hereinafter, a preferred embodiment of the present invention will be described in detail while referring to the accompanying drawings.

Figure 1:
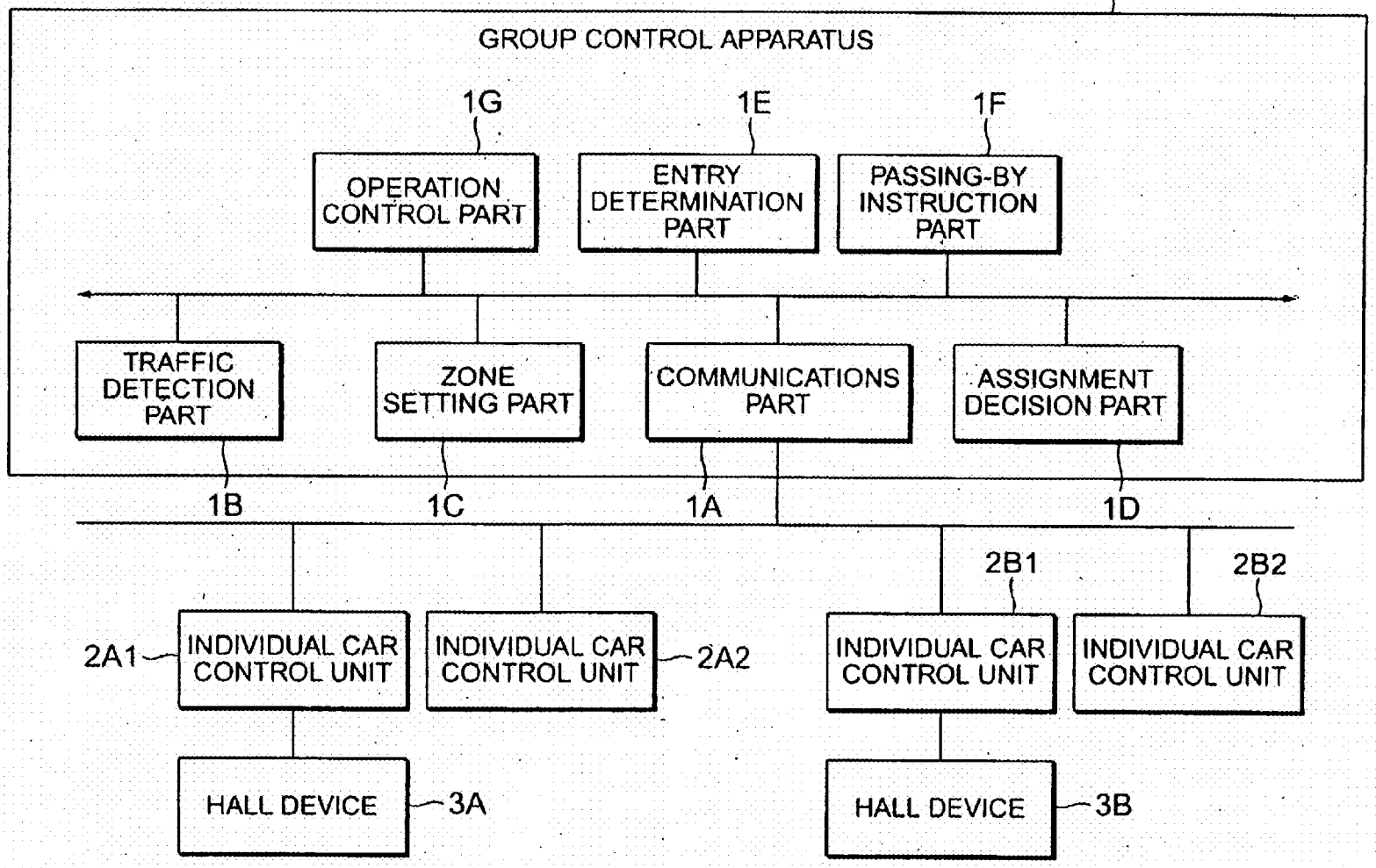
FIG. 1 is a view illustrating the overall construction of an elevator group control apparatus according to an embodiment of the present invention.
Figure 2:
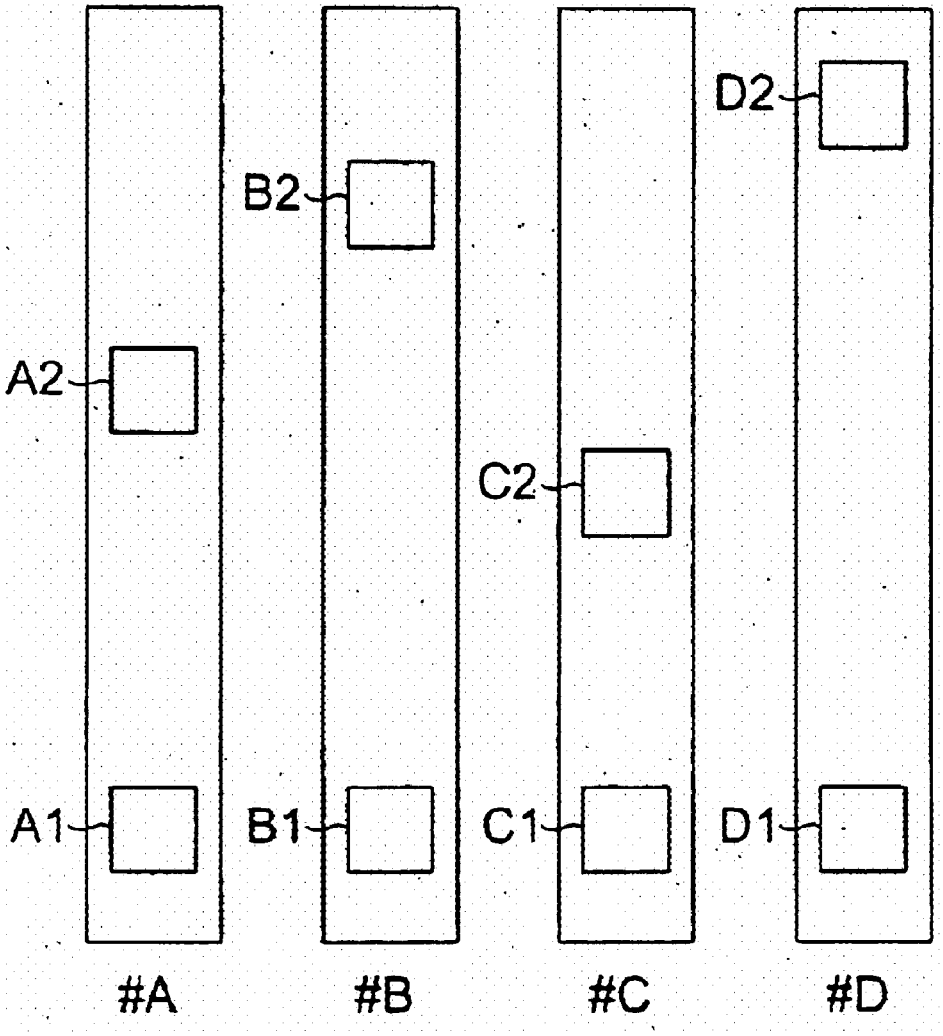
FIG. 2 is an explanatory view illustrating an example of an elevator system which is to be controlled by the present invention.

FIG. 1 is a block diagram which shows the overall arrangement of an elevator group control apparatus according to an embodiment of the present invention. FIG. 2 shows an example of a system having four shafts on one bank, illustrating the case in which two cars operate in each shaft.

In FIG. 1, this system includes a group control apparatus which effectively supervises and controls a plurality of cars, and a plurality of individual car control units 2A1, 2A2, 2B1 and 2B2 which control corresponding cars, respectively. The individual car control units 2A1 and 2A2 are shown as controlling a lower car A1 and an upper car A2, respectively, which operate in an shaft #A of FIG. 2. Also, the individual car control units 2B1 and 2B2 similarly correspond to a shaft #B.

Here, note that though only two shafts (for four cars) are shown in FIG. 1 for the convenience of explanation, the number of shafts is not limited to this but may be one or three or more. The number of shafts is generally limited up to eight from a point of view of passengers' convenience and easiness in riding at halls in the usual group control, but there is no limitation on the shaft number purely in terms of control itself. In addition, hall devices 3A, 3B in FIG. 1 are shown for collectively illustrating various hall devices such as call buttons, hall lanterns, etc., to be installed on each hall.

Moreover, the group control apparatus 1 of FIG. 1 includes a plurality of functional parts or means constituted or implemented by software on a microcomputer.

That is, the group control apparatus 1 includes: a communication interface 1A which performs communications and data transmission with the individual car control units 2A1, 2A2, 2B1 and 2B2; a traffic detection part 1B which detects data of car traffic taking place in a building; a zone setting part 1C which sets a special or dedicated zone and a common zone for each of the upper and lower cars in accordance with the results of detection of the traffic detection part 1B; an assignment decision part 1D which selects, upon generation of a new call from a certain hall, a car to be assigned to the new call in accordance with the traffic condition of the building detected by the traffic detection part 1B and a zone set by the zone setting part 1C; an entry determination part 1E which, when one car in each shaft is coming into the common zone from its dedicated zone, determines based on the position, the direction of movement, and the state of the other car in the same shaft whether the one car is permitted to enter the common zone; a passing-by instruction part 1F which generates a passing-by or waiting instruction from within the common zone to a prescribed floor in a dedicated zone so that a car in the common zone is made to exit from the common zone to its dedicated zone without fail after each car has entered the common zone; and an operation control part 1G which controls the operation of each car based on the results of the decision, the judgment and the instruction, respectively, of the assignment decision part 1D, the entry determination part 1E and the passing-by instruction part 1F.

Next, before describing the operation of this embodiment of the present invention, reference will be made to the setting of the dedicated zones and the common zone according to the present invention while using FIG. 3 and FIG. 4.

Figure 3:
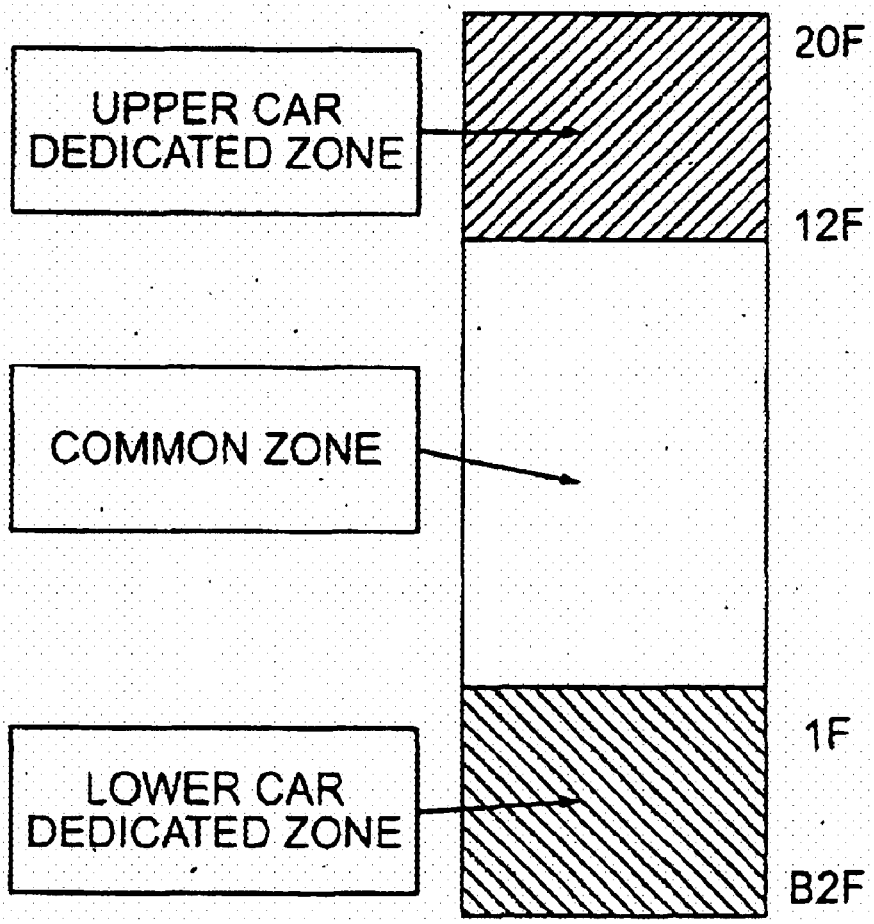
FIG. 3 is an explanatory view illustrating an example of zone setting in the embodiment of the present invention.

FIG. 3 shows an example of setting these zones. FIG. 3 illustrates an example of a building with twenty stories above ground and two stories under ground, which includes a lower car special or dedicated zone comprising floors B2F through 1F (i.e., from the 2nd basement floor to the 1st floor), an upper car special or dedicated zone comprising floors 12F through 20F (i.e., from the 12th floor to the 20th floor), and a common zone comprising all the floors other than those belonging to the lower car dedicated zone or the upper car dedicated zone (i.e., from the 2nd floor to the 11th floor). These dedicated zones are set such that the upper cars and the lower cars can be controlled to exclusively serve the floors in their dedicated zones, respectively, so as to avoid collisions of the upper and lower cars as much as possible.

Figure 4:
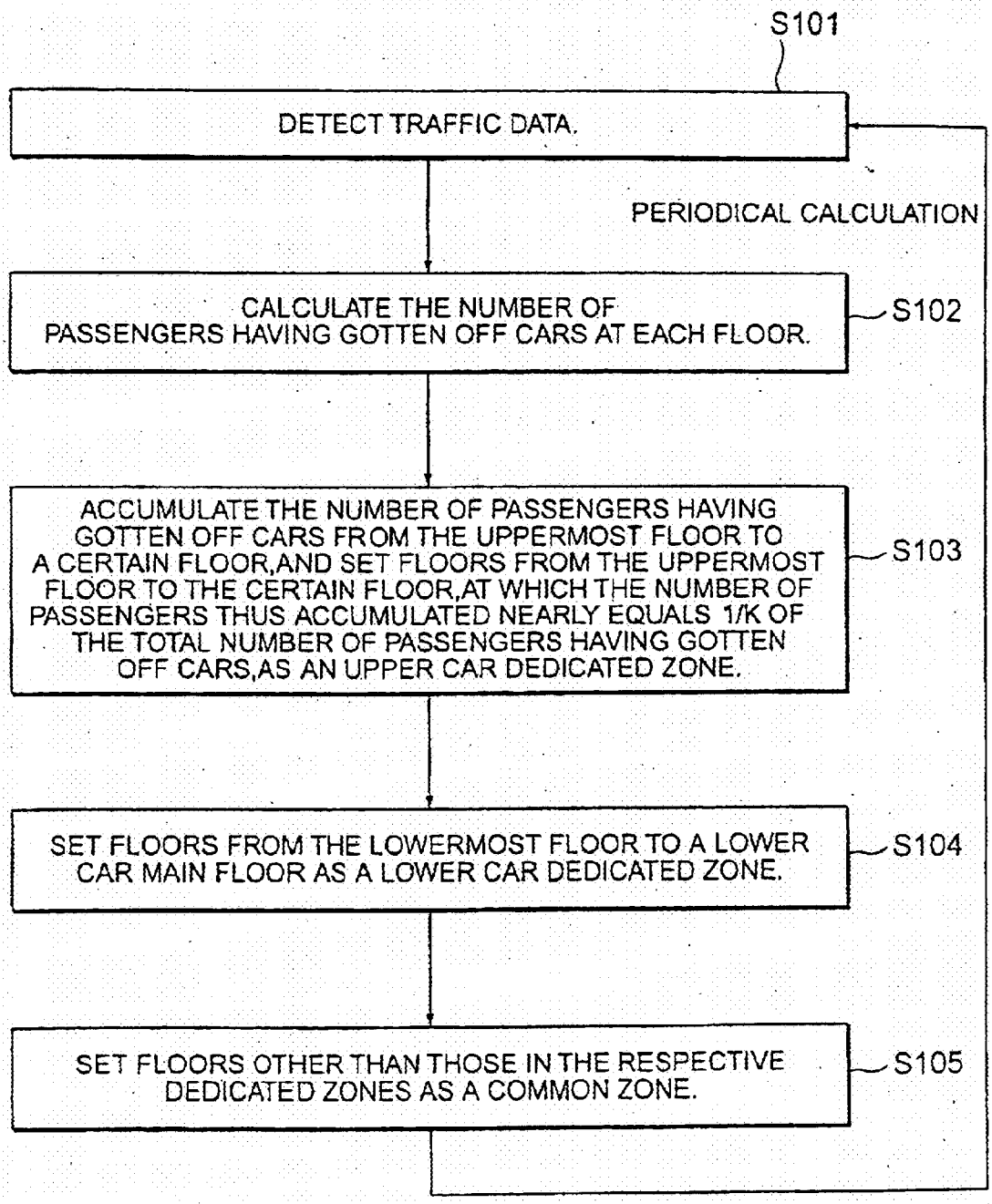
FIG. 4 is a flow chart illustrating dedicated zone and common zone setting procedures in the embodiment of the present invention.

FIG. 4 is a flow chart showing procedures for setting the dedicated zones and the common zone, which will be described below.

First of all, in step S101, the traffic detection part 1B detects traffic data in the building regularly, for instance every 30 minutes. In step S102, the traffic data thus detected is subjected to statistical processing, so that the number of persons or passengers having gotten off the cars at each floor is calculated during a period of time from the last traffic detection to the current detection. Then, in step S103, the number of those who have gotten off the cars at each floor is accumulated or added sequentially from the uppermost floor, and when the accumulative number added from the uppermost floor to a certain floor becomes equal to or exceeds 1/k of the total number of the persons having gotten off the cars at all the floors, those floors from the uppermost floor to the certain floor are set as the upper car dedicated zone.

In step S104, floors ranging from the lowermost floor to a lower car main floor are set as the lower car dedicated zone. The main entrance floor of the building, which is usually the most crowded place therein, is designated as the lower car main floor. For instance, in case of a building in which the main entrance floor is the 1st floor 1F without provision of any basement, only the 1st floor 1F becomes the lower car dedicated zone. In general, there are a large number of passengers accessing the main entrance floor of the building, and hence if the main entrance floor is served by all the upper and lower cars, interference between the upper and lower cars would be liable to be developed. This is the reason why those floors equal to or below the main entrance floor are designated as the lower car dedicated zone. In addition, k in the above-mentioned steps S103 and S104 is a parameter, and it may be set to an appropriate value through simulations as necessary.

In step S105, floors other than the upper car dedicated zone and the lower car dedicated zone are set as the common zone. The procedures of the above-mentioned steps S102 through S105 are carried out by the zone setting part 1C.

The above-mentioned method shown in the flow chart of FIG. 4 is to set the zones in accordance with a change in traffic. However, another method can be considered from the viewpoint of usability of passengers. For instance, in case of the main entrance floor being the 1st floor 1F, floors equal to or below the 1st floor 1F are set as the lower car dedicated zone as referred to above, and floors from the uppermost floor to a floor corresponding to 1/k of the total number of the passengers having gotten off the cars at all the floors are simply set as the upper car dedicated zone. Thus, when the lower and upper car dedicated zones are set as shown in FIG. 3 for example, an indication "The passengers going to floors above the 11th floor must get on cars at the 2nd floor." or the like is made at the 1st floor, so that the passengers going to the upper car dedicated zone from the 1st floor can be guided toward the 2nd floor 2F This is identical to the case in which an indication "The passengers going to even-number floors must get on cars from the 2nd floor 2F." is made in a double deck system.

When the above indication is made, it is desired from the viewpoint of usability of passengers that the setting of the dedicated zones is fixed. On the contrary, when the procedures of FIG. 4 are carried out, that is, when the zone setting is made variable according to the amount of traffic, it is necessary to adopt a display device so that passengers can clearly recognize an indication of the variable zone setting appearing on the display.

Now, reference will be made to the schematic operation of the embodiment at the time of call assignment while using a flow chart of FIG. 5, which schematically illustrates a call assigning operation in this embodiment.

Figure 5:
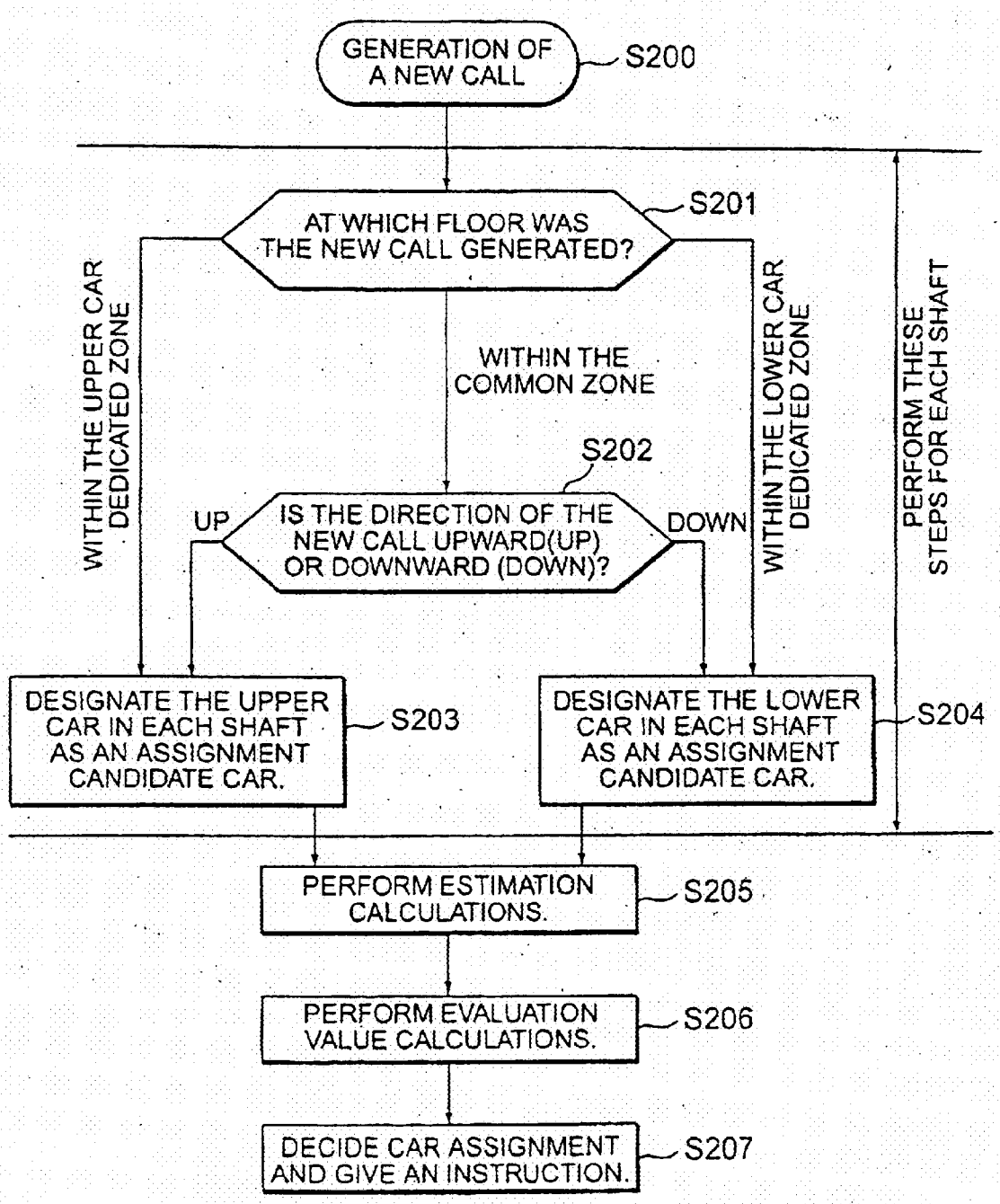
FIG. 5 is a flow chart schematically illustrating a call assigning operation in the embodiment of the present invention.

When a new call is generated, the call and the state of each car is transmitted to the individual car control units 2A1, 2A2, 2B1 and 2B2 through the communications interface 1A, as shown in step S200 of FIG. 5. Then in step S201, classification is carried out based on the data thus transmitted according to the floor at which the new call is generated, and the following procedures are performed.

When the new call generation floor exists in the upper car dedicated zone, the upper car in each shaft is designated as an assignment candidate car in step S203. Similarly, when the new call generation floor exists in the lower car dedicated zone, the lower car in each shaft is designated as an assignment candidate car in step S204.

In addition, when the new call generation floor exists in the common zone, the direction of the call is determined in step S202, and when the call direction is determined to be upward in step S203, the upper car in each shaft is designated as an assignment candidate car. The reason for this is that there is a possibility that a destination floor for an UP (upward) call comes in the upper car dedicated zone. On the contrary, when it is determined in step S204 that the new call is a DOWN (downward) call, the lower car in each shaft is designated as an assignment candidate car. Here, note that the abovementioned procedures of steps S201 through S204 are performed for each shaft.

Subsequently, the procedures of step S205 and the following steps are performed for the assignment candidate cars designated in the abovementioned steps S203 and S204.

First of all, in step S205, estimation calculations are carried out for an assumption that the new call is not assigned to each car, and for another assumption that the new call is assigned to a car. These estimation calculations are a procedure for stochastically calculating an estimated arrival time at which each car can arrive at each floor (i.e., a period of time in seconds in which each car will be able to arrive at each floor), and an in-car estimated load (i.e., the number of passengers in each car at each floor after passengers have gotten off and on each car), and such a procedure has been conventionally adopted widely in the field of elevator group control systems. Therefore, details of the procedure are omitted here.

In addition, in step S206, various evaluation index values are calculated for each assignment candidate car. Such evaluation indices include a waiting time evaluation, a crowdedness evaluation, a riding time evaluation, etc. Any of these indices can be calculated from the results of the estimation calculations in step S205, and are conventionally adopted widely in the elevator group control systems as in the above-mentioned estimation calculation procedure. Therefore, details of procedures for calculating the evaluation indices are also omitted here.

In step S207, an integrated evaluation is effected based on the various evaluation indices calculated according to the procedures up to step S206, and a final assignment car is decided. The procedures up to the above-mentioned step S207 are carried out by the assignment decision part 1D.

Thereafter, when the assignment car is finally decided, the operation control part 1G performs operation control based on an assignment instruction.

The above description is an explanation of the schematic operation of the embodiment of the present invention at the time of call assignment.

Next, reference will be schematically made to a common zone entry determination operation and a passing-by or waiting operation according to this embodiment while using FIGS. 6A through 6E and FIG. 7.

Figures 6A, 6B, 6C, 6D, 6E:
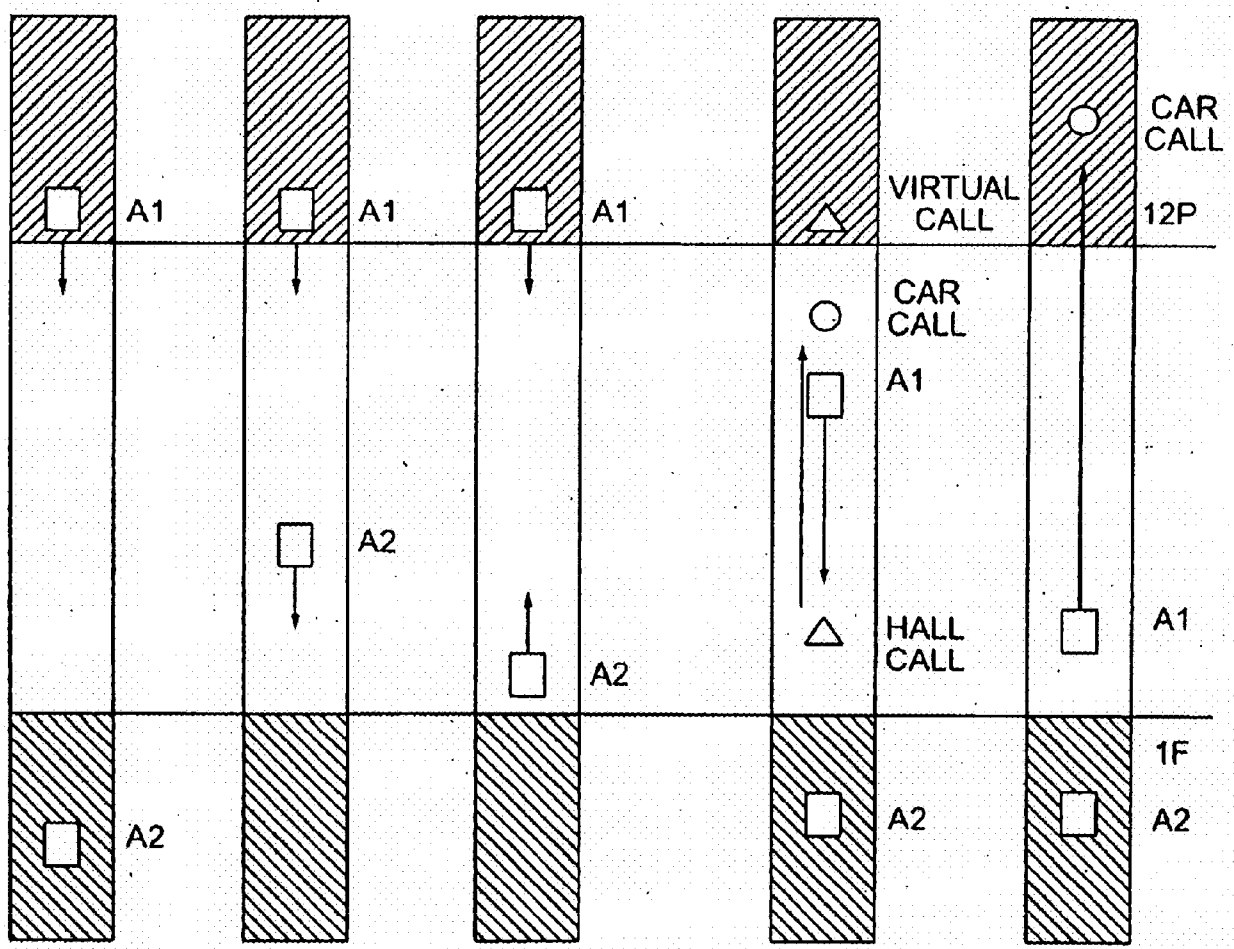
FIGS. 6A through 6E are views explaining an entry determination and a passing-by operation in the embodiment of the present invention.
Figure 7:
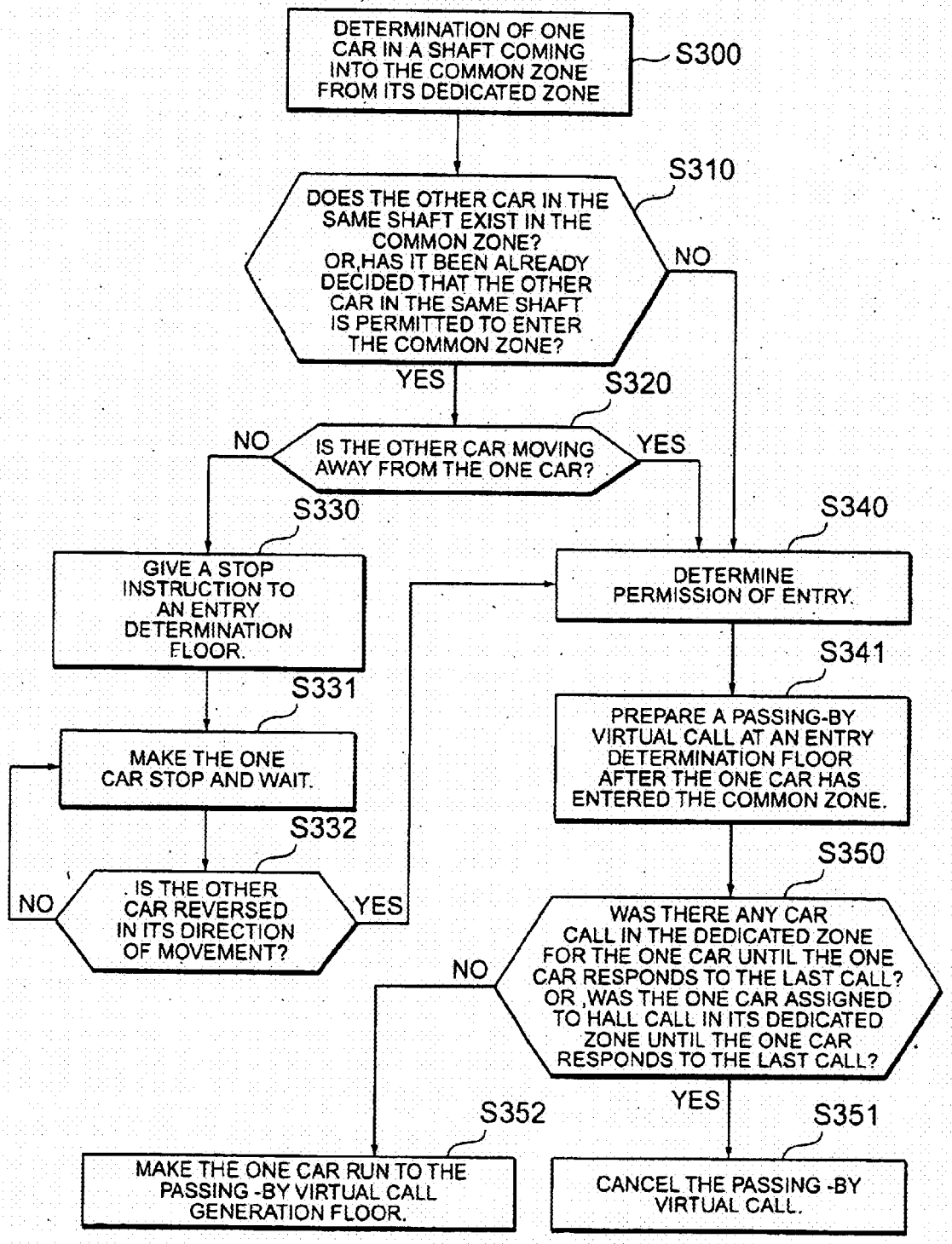
FIG. 7 is a flow chart schematically illustrating the entry determination and the passing-by operation in the embodiment of the present invention.

FIGS. 6A through 6C are views illustrating these operations, and FIG. 7 is a flow chart which illustrates the entry determination operation and the passing-by operation in this embodiment.

First, an entry determination as to whether a car is permitted to come into the common zone from its dedicated zone will be described below. In examples shown in FIGS. 6A through 6E, floors above the 11th floor 11F are set as the upper car dedicated zone, and floors below the 2nd floor 2F are set as the lower car dedicated zone. An end or peripheral (common zone side) floor of each dedicated zone is assumed to be an entry determination floor. That is, in the examples of FIGS. 6A through 6E, the 12th floor 12F is an entry determination floor for the upper car, and the 1st floor 1F is an entry determination floor for the lower car.

Now, an explanation will be made about the case in which an entry determination is made when the upper car A1 is coming into the entry determination floor 12F, as shown in FIGS. 6A through 6C.

When an entry determination for one car in each shaft is started in step S300 of FIG. 7, it is first determined in step S310 whether the other car in the same shaft exists in the common zone or it is determined whether a decision of the other car entering the common zone has already been made.

When the lower car A2 exists in the lower car dedicated zone as in the example shown in FIG. 6A, that is, when a negative determination (NO) is made in step S310, it is judged that there is no danger of the one car colliding with the other car in the same shaft, and hence it is determined that the one car is permitted to enter the common zone. On the contrary, when a positive determination (YES) is made in step S310, it is further determined in step S320 whether the other car is moving away from the one car.

When the lower car A2 is moving in the downward direction as in the example shown in FIG. 6B, that is, when a positive determination (YES) is made in step S320, it is also judged that there is a low probability of danger of collisions, and hence it is determined in step S340 that the one car is permitted to enter the common zone. On the other hand, when the lower car A2 is moving in the upward direction as in the example shown in FIG. 6C, that is, when a negative determination (NO) is made in step S320, it is judged that there is a high probability of danger of collisions if the one car enters the common zone, so the one car is stopped at the entry determination floor in step S330, and an instruction is given to the one car to temporarily stop and wait there, as shown in step S331. Thereafter, if it is determined in step S332 that the other car is reversed to move in a direction away from the one car, it is determined in step S340 that the one car is permitted to enter the common zone, as a result of which the one car starts to enter the common zone.

The above procedures up to step S340 is an outline of the common zone entry determination operation, which is carried out by the entry determination part 1E.

Next, the passing-by or waiting operation will be schematically described below. When the one car comes into the common zone after the permission of entry is determined in step S340 as shown in FIG. 7, a virtual call for passing-by or waiting is prepared at the entry determination floor in step S341. For instance, in the example as shown in FIG. 6D, when the destination floor (car call) of a passenger who got on the upper car A1 by a hall call after the upper car A1 had responded to the hall call in the common zone exists in the common zone, that car call becomes the final call for the upper car A1.

Accordingly, if a passing-by virtual call is not prepared at the entry determination floor, the upper car A1 is made to stop and wait in the common zone, so there will develop a so-called dead-locked state for the lower car A2 in which floors equal to or above the floor at which the upper car A1 is staying or waiting cannot be served by the lower car A2. Thus, if a virtual call is prepared at the entry determination floor as in the example shown in FIG. 6D, the upper car A1 will always be moved to the upper car dedicated zone without fail, and thereafter, it becomes possible for the lower car A2 to serve all the floors in the common zone.

Moreover, when a car call was generated in the upper car dedicated zone until the upper car A1 responds to the last call, or when the upper car Al was assigned to a hall call generated in the upper car dedicated zone until the upper car A1 responds to the last call (YES in step S350) as in the example shown in FIG. 6E, the upper car A1 will be returned to the upper car dedicated zone even if a virtual call is not prepared at the entry determination floor. Thus, in this case, a virtual call for passing-by or waiting is canceled in step S351. As a result, useless or unnecessary stop or waiting for passing-by can be avoided.

In addition, in case of "NO" in step S350, the upper car A1 will be run toward the entry determination floor at which the passing-by virtual call was prepared, as shown in step S352. The above steps from S341 to S352 of FIG. 7 are an outline of the passing-by or waiting operation, which is carried out by the passing-by instruction part 1F.

As described in the foregoing, according to the present invention, there is provided an elevator group control apparatus in an elevator system with two vertically movable elevators operating in each shaft. The elevator group control apparatus includes: a traffic detection part which detects data of car traffic generated in a building; a zone setting part which sets a dedicated zone and a common zone for each of upper and lower cars in accordance with the results of detection of the traffic detection part; an assignment decision part which decides a car to be assigned to a call generated at a hall in accordance with a call generation floor, a direction of the call, and a zone set by the zone setting part; an entry determination part which, when one of two cars in each shaft is coming into the common zone from its dedicated zone, determines, based on the position, the direction of movement, and the state of the other car in the same shaft, whether the one car in each shaft is permitted to enter the common zone; a passing-by instruction part which gives a passing-by instruction to a prescribed floor in the dedicated zone so as to make each car exit from the common zone to its dedicated zone after each car has entered the common zone; and an operation control part which controls operation of each car based on the results from the assignment decision part, the entry determination part and the passing-by instruction part. With this arrangement, it is possible to achieve excellent operation efficiency while preventing collisions of the cars in each shaft as much as possible.

Moreover, the passing-by instruction part prepares a virtual call at the lowermost floor of the upper car dedicated zone when the upper car has entered the common zone, and a virtual call at the uppermost floor of the lower car dedicated zone when the lower car has entered the common zone. Thus, the danger of collisions of the cars can be minimized.

In addition, the passing-by instruction part cancels a passing-by virtual call when a car, which exists in the common zone and already has a passing by virtual call, has been assigned to a hall call generated in the dedicated zone, or when a car call for making a car come to its dedicated zone has been given to a car existing in the common zone and already having a passing-by virtual call. Thus, it is possible to prevent useless or unnecessary stop of a car for passing-by of another car in the same shaft, thereby making it possible to improve the transportation efficiency.

While the invention has been described in terms of a preferred embodiment, those skilled in the art will recognize that the invention can be practiced with modifications within the spirit and scope of the appended claims.

What is claimed is:

1. An elevator group control apparatus in an elevator system with two vertically movable elevators operating in each shaft, said elevator group control apparatus comprising:

a traffic detection part which detects car traffic generated in a building;

a zone setting part which sets a respective dedicated zone from each of upper and lower cars and a common zone for the upper and lower cars, in accordance with a detection by said traffic detection part;

an assignment decision part which decides a car to be assigned to a call generated at a hall in accordance with a call generation floor, a direction of response to the call, and a zone set by said zone setting part;

an entry determination part which, when a first car of the upper and lower cars in each shaft is entering the common zone from a dedicated zone, determines, based on position, direction of movement and state of a second car of the upper and lower cars in the same shaft, whether the first car is permitted to enter the common zone;

a passing-by instruction part which gives a passing-by instruction to a prescribed floor in the dedicated zone so each of the upper and lower cars exits from the common zone to a dedicated zone after each of the upper and lower cars has entered the common zone; and an operation control part which controls operation of each car based on an assignment by said assignment decision part, a determination by said entry determination part, and an instruction by said passing-by instruction part.

2. The elevator group control apparatus according to claim 1, wherein said passing-by instruction part prepares a virtual call at a lowermost floor of the dedicated zone of the upper car when the upper car has entered the common zone, and a virtual call at an uppermost floor of the dedicated zone of the lower car when the lower car has entered the common zone.

3. The elevator group control apparatus according to claim 1, wherein said passing-by instruction part cancels a passing-by virtual call when a car, located in the common zone and already having a passing-by virtual call, has been assigned to a hall call generated in the dedicated zone of the car, or when a car call for making a car return to a dedicated zone has been given to a car located in the common zone and already having a passing-by virtual call.

* * * * *